US006905015B2

(12) United States Patent
Hernandez, Jr. et al.

(10) Patent No.: US 6,905,015 B2
(45) Date of Patent: Jun. 14, 2005

(54) TOOL CASE WITH COVER MEMBER SUPPORT

(75) Inventors: Hector R. Hernandez, Jr., Whittier, CA (US); Vincent S. Romeo, Corona, CA (US)

(73) Assignee: All Trade Tools LLC, Long Beach, CA (US)

( * ) Notice: Subject to any disclaimer, the term of this patent is extended or adjusted under 35 U.S.C. 154(b) by 224 days.

(21) Appl. No.: 10/228,016

(22) Filed: Aug. 26, 2002

(65) Prior Publication Data

US 2004/0035748 A1 Feb. 26, 2004

(51) Int. Cl.[7] ..... B65D 51/04; B65D 25/28; B65D 43/16; B65D 85/20

(52) U.S. Cl. ..... 206/45.24; 206/45.23; 206/373; 206/376; 220/826; 220/844

(58) Field of Search ..... 206/45.2, 45.23, 206/45.24, 372, 373, 376, 748; 220/629, 826, 844, 848; 190/16

(56) References Cited

U.S. PATENT DOCUMENTS

| | | | | | |
|---|---|---|---|---|---|
| 457,598 | A | * | 8/1891 | Briggs | 206/45.23 |
| 1,670,496 | A | * | 5/1928 | De La Fontaine | 190/16 |
| 1,933,894 | A | * | 11/1933 | Clink | 206/376 |
| 2,642,202 | A | * | 6/1953 | Cowan | 220/844 |
| 2,809,766 | A | * | 10/1957 | Anderson | 220/826 |
| 2,869,769 | A | * | 1/1959 | Robinson | 220/629 |
| 3,058,579 | A | * | 10/1962 | Morin et al. | 206/748 |
| 3,804,238 | A | * | 4/1974 | Howard | 206/372 |
| 5,927,487 | A | * | 7/1999 | Whittle et al. | 206/45.2 |
| 6,450,354 | B2 | * | 9/2002 | Chien | 206/373 |
| 6,523,687 | B2 | * | 2/2003 | Ling | 206/373 |

* cited by examiner

*Primary Examiner*—Bryon P. Gehman
(74) *Attorney, Agent, or Firm*—John J. Connors; Connors & Assoc. Inc

(57) ABSTRACT

A portable tool case is disclosed that may be displayed in numerous orientations using a cover member of the tool case as a support. The cover member that may be rotated into a support position to support the tool case on a surface. The cover member may comprise a pair of covers that are manipulated into an easel, display or table orientation.

10 Claims, 11 Drawing Sheets

TOOL CASE WITH COVER MEMBER SUPPORT

INCORPORATION BY REFERENCE

Applicant hereby incorporates herein by reference any and all U.S. patents, U.S. patent applications, and other documents and printed matter cited or referred to in this application.

BACKGROUND OF INVENTION

Portable tool cases have long been used to store tools, enabling convenient transportation and retrieval of tools from the case. Tool cases may also be used to merchandise sets of tools. A desirable attribute of such tool cases is that they are capable of displaying the tool set, so that a prospective customer can see the tools held by the case. Tool cases typically comprise a storage area with a cover. The storage area may have a number of recesses where the tools are stored. These recesses usually have an overall shape that conforms to the shape of the tool to be stored therein. An individual tool is placed within its designated recess, fitting snugly therein so that it will not be dislodged unless manually pulled from the recess. To access the tools, the tool case should be below eye level so that the user can look into the interior of the case. Often times, however, the tool case is above the eye level of the user, for example, when the user is working under a car, and the tool case is lying on a floor. To access the tools, the user must move his or her body out from underneath the car, sit up, look into the tool case to find a desired tool, and then crawl back under the car, where the tool is then used. Thus, it would be advantageous if a tool case had a mechanism with which it could be orientated into a desired position, such as a position allowing a user to view the storage area from a prone position. Moreover, it would be advantageous if this mechanism were a component part of the tool case. It would also be advantageous if the tool case could also be used to display the tool set on a counter top or other location in a manner that allows a prospective customer to see the tools within the case.

SUMMARY OF INVENTION

This invention has several features that are summarized in the CLAIMS. These features provide this invention with its many desirable attributes. After reading the following section entitled "DETAILED DESCRIPTION," one will understand how the features of this invention provide its benefits, which include, but are not limited to, providing a portable tool case that can be supported in a display, table and/or easel position using the cover of the case as a support mechanism.

This invention has several features. Without limiting the scope of this invention as expressed by the claims that follow, its more prominent features will now be discussed briefly. After considering this discussion, and particularly after reading the section entitled, "DETAILED DESCRIPTION," one will understand how one or more features of this invention provide its benefits, which include, but are not limited to, providing a portable tool case that is adaptable to display contained items and provides easy access to contents within. A feature of the portable tool case is a cover that may be used to support the case on a support surface.

A first feature of this invention is that it provides a portable display case capable of storing one or more tools.

It includes a tray body and at least one cover member that is rotatable into one of a multiple of different positions or orientations, all of which function to support on a substantially planar support surface the display case of this invention.

A second feature is that the cover member preferably has a substantially rectangular configuration, a base side and a storage side adapted to hold the tool or tools. The cover member is rotatably supported on the tray body for manual movement through an arc that is equal to or greater than 270° to move the cover member from a closed position where it substantially covers the storage side to a support position where the cover member and base side are at an angle of 90° or less. The cover member has a face surface that faces the storage side when in the closed position, and when in a support position, rests on a support surface. The cover member also has a first pair of opposed edges and a second pair of opposed edges and is rotatably supported on the tray body by a coupling at one of the first pair of opposed edges. When the cover member is in an alternate support position or orientation, one of the second pair of opposed edges rests on a support surface.

Optionally, when in the closed position, the tray body and cover member may be latched together by a latch member capable of coupling together the tray body and cover member such that the movement of the cover member is prevented. Preferably, the cover member has a transparent portion and may be entirely transparent.

A third feature is that the cover member is rotatably supported a hinge element that is along an edge of the tray body. The hinge element comprises a cover hinge element integral with said cover member and a tray hinge element integral with said tray body. Either one has two insertable portions and a cylinder extending between the two insertable portions, and the other one has two insert receivers and a slotted receiver disposed between the two insert receivers. When the cover member is hinged to the tray body, each of the insertable portions are inserted into an insert receiver, and the cylinder is inserted into the slotted receiver.

A fourth feature is that the tray body has a plurality of recesses within, each having open mouths on the storage side. The open mouths have a shape substantially identical to the overall shape of an individual tool to be retained in the recess.

A fifth feature is that the display case includes a removable insert comprising an inserted portion and a lever portion. The insert portion is coupled to the tray body along an edge of the tray body by inserting the inserted portion into a receiver located near the edge of the tray body and the lever portion supports the tray body on a substantially planar support surface.

In one preferred embodiment, the tray body has opposing edges that substantially define a first predetermined area of the support side. There is a pair of substantially rectangular, equally sized cover members attached to the tray body. Each one of the pair of cover members has opposed edges that substantially define a second predetermined area that is substantially equal to a bisection of the first predetermined area. Each one of the pair of cover members is rotatably supported by a hinge element that is along one opposing edge of the tray body. The cover members each have an inner and outer edge, and each of the cover members is rotatably supported on the tray body by a coupling at the outer edges. When the cover members are in one of the multiple support positions or orientations, the inner edges rest on a support surface. The use of the pair of cover members enables the display case to rest on the support surface in one of three different orientations:

(1) An easel orientation support position where one of the cover members projects outward from the base side and the face surface of this one cover member rests on the planar support surface.

(2) A display orientation support position where one set of edges of both cover member rests on the planar support.

(3) A table orientation support position where another set of edges of both cover member rests on the planar support.

DESCRIPTION OF DRAWINGS

The preferred embodiment of this invention, illustrating all its features, will now be discussed in detail. This embodiment depicts the novel and non-obvious apparatus of this invention as shown in the accompanying drawings, which are for illustrative purposes only. These drawings includes the following figures (Figs.), with like numerals indicating like parts.

DETAILED DESCRIPTION

One Embodiment of this Invention

Figure 1:
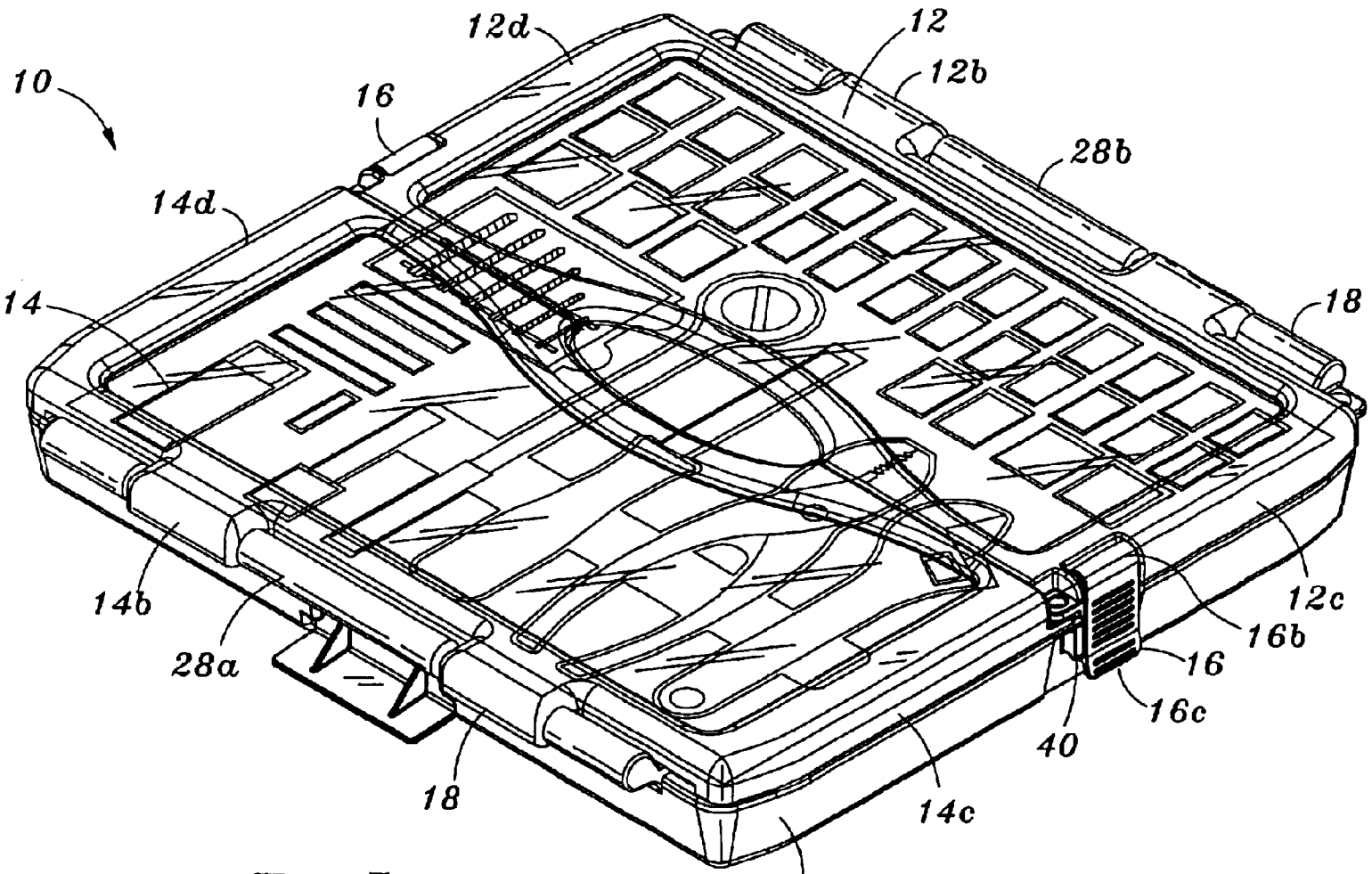
FIG. 1 is a perspective view of one embodiment of the tool case of this invention with the cover member closed.

As illustrated in FIGS. 1, 2, 5, 6, 7 and 8, a tool case 10 of this invention includes a tray body 20 used to store tools and a pair of rectangular shaped cover members 12 and 14. The tray body 20 has a rectangular shape defined by edges 26*a*, 26*b*, 28*a*, 28*b*, a storage side 24, and a base side 22, which may also be referred to as the underside of the tool case 10. The tools are stored within recesses 11 in the storage side 24; these recesses typically have a shape like that of the individual tool stored therein.

The cover members 12, 14 cover the storage side 24 of the tool case 10 and each are coupled to the tray body 20 through a hinge 18. Typically, the hinge 18 connects an edge 12*b*, 14*b* of a cover member to an edge 28*b*, 28*a* of the tray, respectively. Typically, the cover members 12, 14 are approximately the same size, and cover the same amount of area of the storage side 24 of the tray 10. The cover members 12, 14 bisect the storage side 24 of the tray such that each cover covers approximately the same surface area of the storage side 24.

Figure 5:
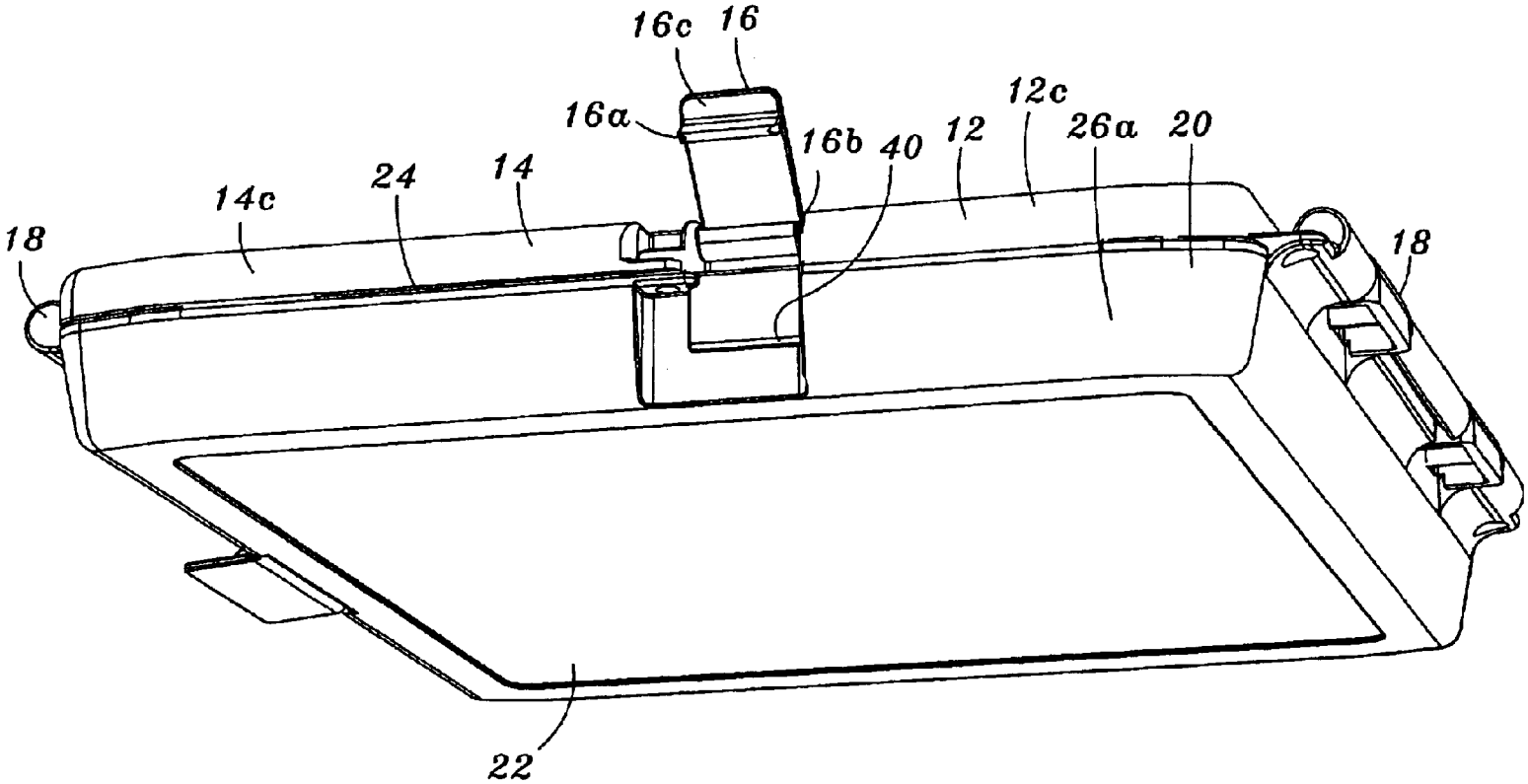
FIG. 5 is perspective view of the base side of the tool case shown in FIG. 1.
Figure 7:
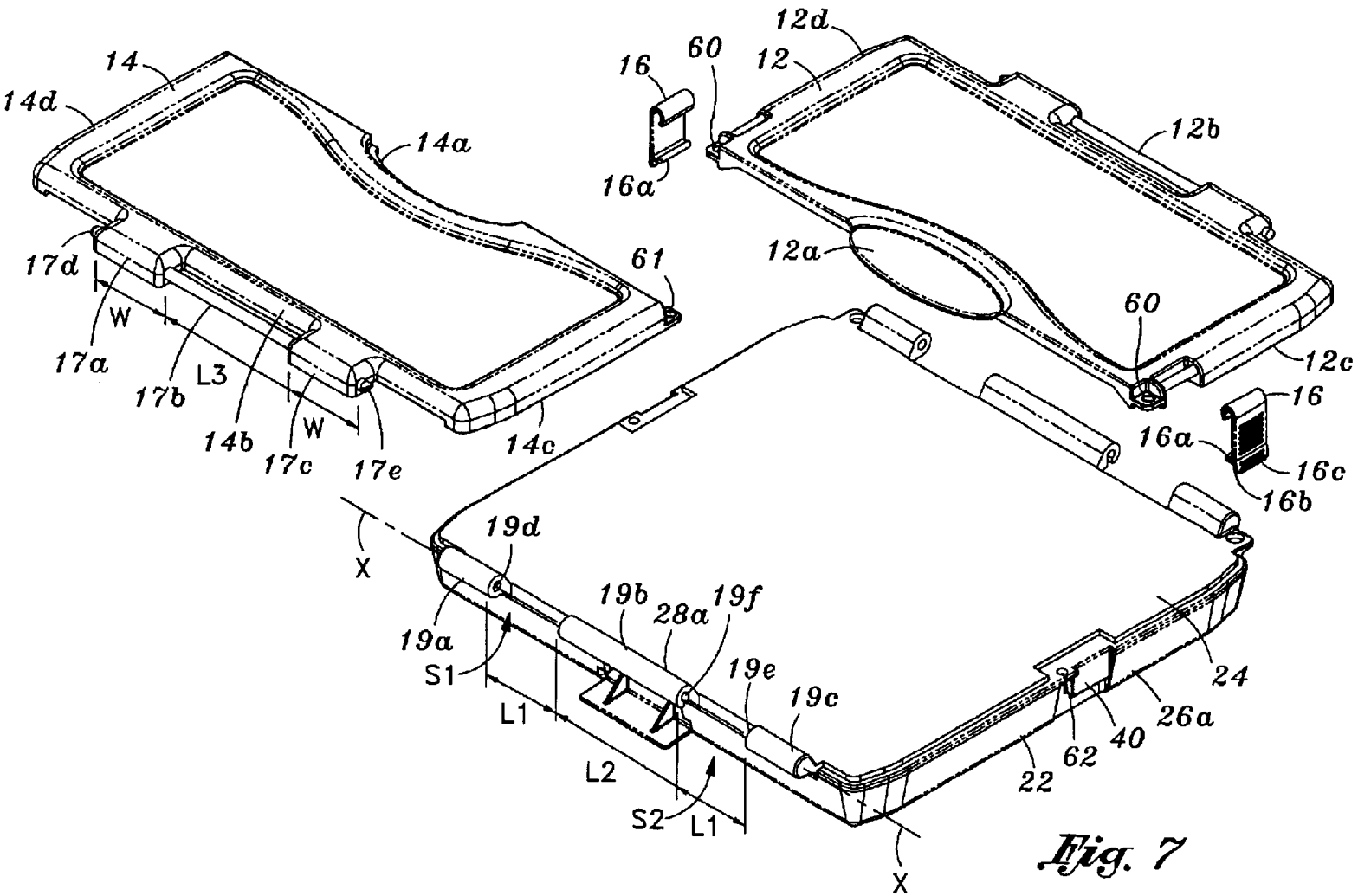
FIG. 7 is an exploded, perspective view of the tool case shown in FIG. 1 with the cover members decoupled from the tray body.

In one embodiment as best shown in FIG. 7, the one cover member 12 has an overlay portion 12*a*, while the other cover member 14 has an underlay portion 14*a*. The cover member 12 with the overlay portion 12*a* may be referred to as the overlay cover, and the cover member 14 with the underlay portion 14*a* may be referred to and the underlay cover. When closed, the overlay cover 12 is laid atop the underlay cover 14 such that the overlay portion 12*a* is atop the underlay portion 14*a*. As best illustrated in FIGS. 1 and 5, a pair of latches 16 are used to hold the cover members 12 and 14 in position when these members closed. Typically, each latch 16 is attached at opposed sides of the overlay cover 12, and each latch 16 has flap 16*a* connected by a hinge segment 16*b* to the overlay cover 12*a*. Each latch 16 is manually coupled to the tray body 20 by moving a free end 16*c* of the flap 16*a* over lip portion 40 on a side of the tray body 20. The latch 16 is kept in place by frictional contact with the lip portion 40 of the tray 20. Thus, the overlay cover 12 restricts the movement of the underlay cover 14, when both are in a closed position and latched together. In one embodiment, a portion of the cover members 12, 14 is transparent, allowing a user to view the tools stored within the tray body 20. Preferably, the cover members are locked in a closed position prior to being sold. With the cover members 12, 14 closed as shown in FIG. 1, there are holes 60 and 61 (FIG. 7) at opposed outer edges in these cover members that are aligned with holes 62 in the tray body 20. A wire type lock member (not shown) extends through these aligned holes 60, 61 and 62 to lock the covers closed. This wire type lock member is severed after the case 10 has been purchased.

Figure 6:
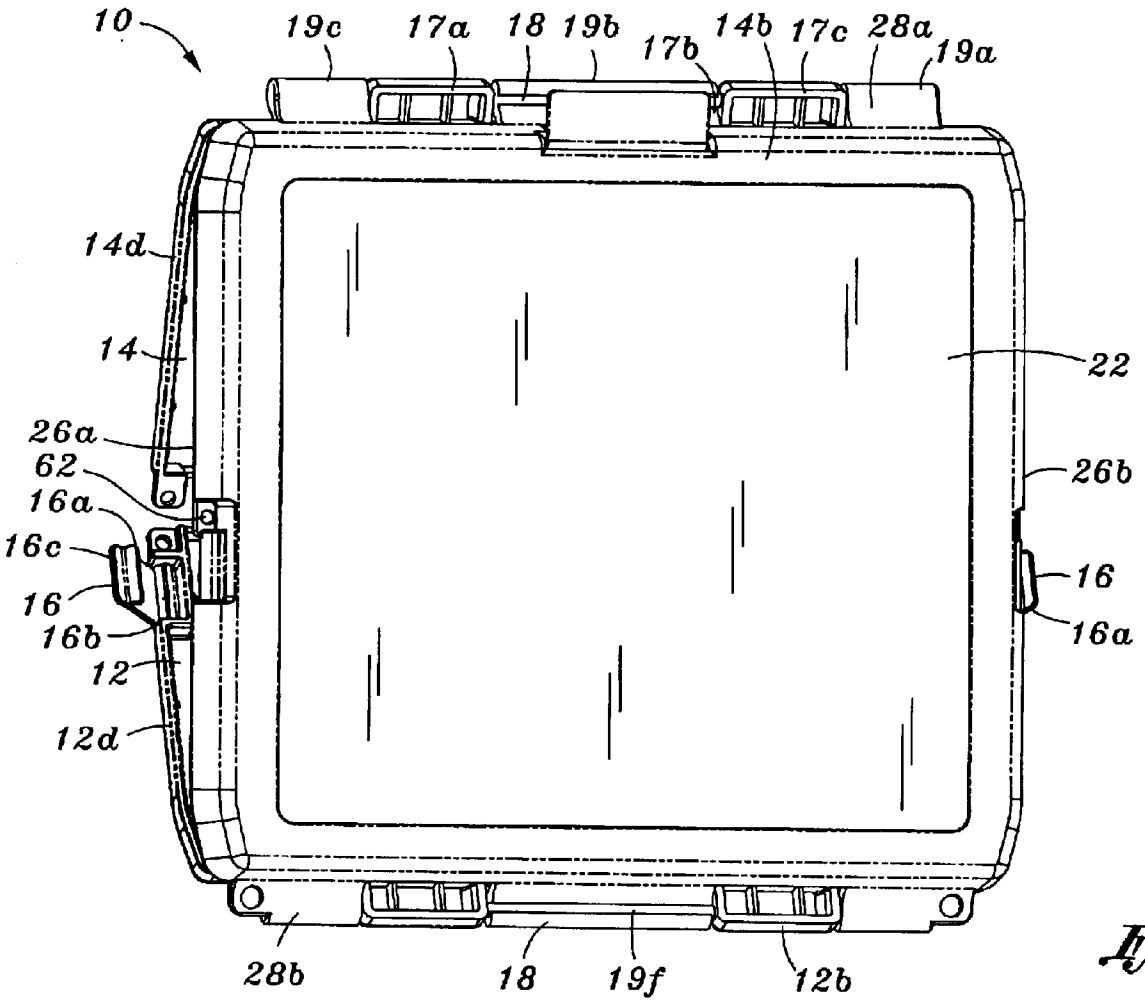
FIG. 6 is a plan view of base side of the tool case shown in FIG. 1.
Figure 8:
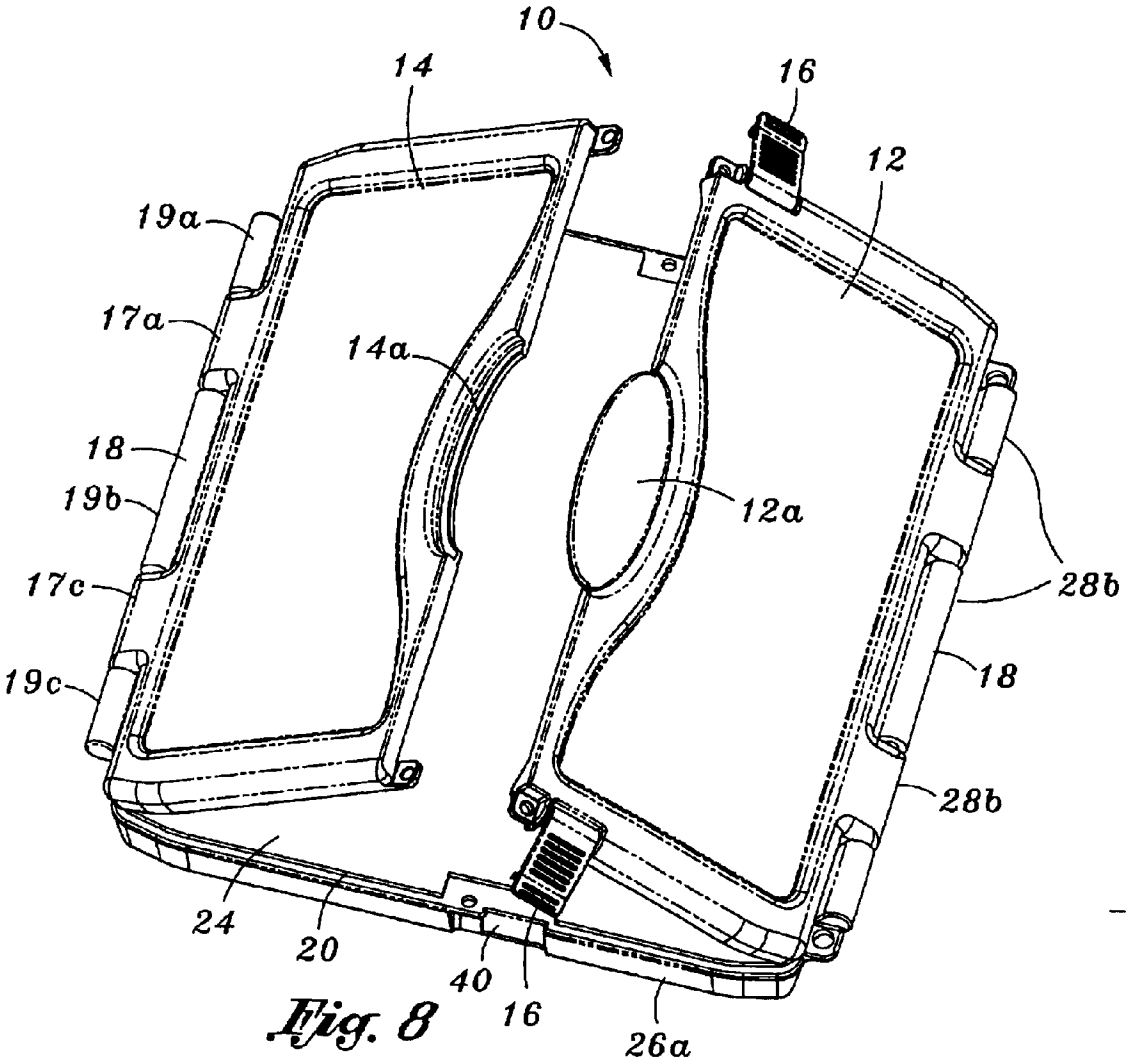
FIG. 8 is a perspective view of the tool case shown in FIG. 1 with the cover members in a partially opened position.

Referring to FIGS. 6, 7, and 8, in one embodiment, the hinges 18 for the cover members 12 and 14 are essentially the same. Each hinge 18 has three hinge elements 17*a*, 17*b*, 17*c* integral with, for example, the cover member 14, and three hinge elements 19*a*, 19*b*, 19*c* integral with the tray body 20. These six elements are connected together to form the hinge 18.

The hinge elements 19*a*, 19*b* and 19*c* are in alignment along a common axis X and spaced apart to separate these elements to create there between the spaces S1 and S2, which are each about the same length L1. Each of the hinge elements 19*a* and 19*c* have, respectively, at inside ends thereof receiver sockets 19*d* and 19*e*. The hinge element 19*b* has a hollow cylindrical configuration with a slot 19*f* in a side wall of the cylinder forming the hinge element 19*b*. This hinge element 19*b* has a length L2.

The two hinge elements 17*a* and 17*c* have a generally rectangular configuration. There is an outer hemispherical tip portion 17*d* extending from an outside end of the hinge element 17*a*, and an outer hemispherical tip portion 17*e* extending from an outside end of the hinge element 17*c*. Each hinge element 17*a* and 17*c* have the same width w and fit snugly within the spaces S1 and S2, respectively, but are free to rotate as will be explained subsequently in greater detail when connected with the hinge elements 19*a* through 19*c*. The hinge element 17*b* is a cylindrical rod extending between and integral with the inside ends of the hinge elements 17*a* and 17*c*. This hinge element 17*b* has a length L3 that is substantially the same as the length L2 of the hinge element 19*b*.

The hinge elements 17*b* and 19*b* are slightly flexible so that may be bent to facilitate connecting the other hinge element together to form the hinge 18. To connect the underlay cover 14 to the tray body 20 the rod hinge element 17*b* is bent outward and the opposed hemispherical tip portions 17*d* and 17*e* are inserted into the receiver sockets 19*d* and 19*e*, respectively. The rod hinge element 17*b* is straightened and inserted through the slot 19*f* in the hinge element 19*b*. When the underlay cover 14 rotates, the rod hinge element 17*b* rotates within the slotted hinge element 19*b*, and the hemispherical tip portions 17*d* and 17*e* rotate within the sockets 19*d* and 19*e*, respectively.

Figure 2A:
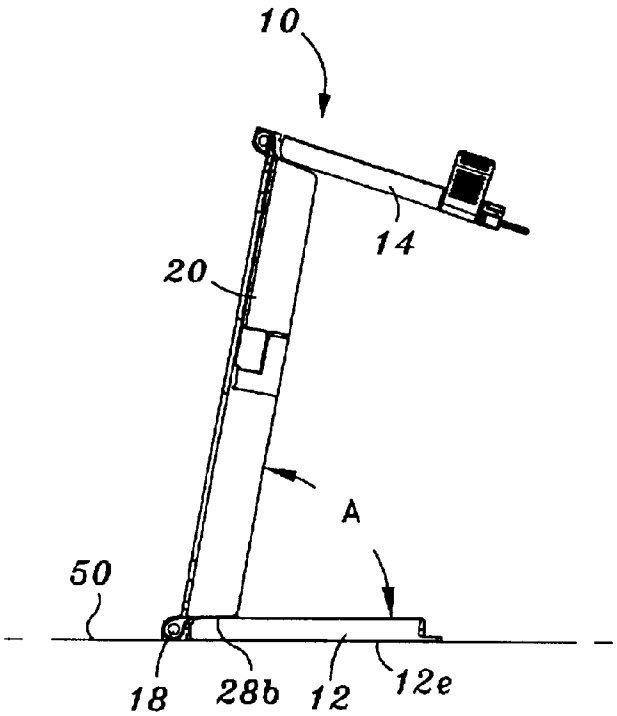
FIG. 2A is a side view of the tool case shown in FIG. 1 in an easel orientation as shown in FIG. 2.

The case 10 may be orientated in three different support positions after the wire type lock member has been detached and the latches 16 have been opened. In accordance with this invention, each cover member 12, 14 is manually rotated through an arc of at least 270°. This enables the case 10 to be rested on a flat, substantially planar support surface 50 in anyone of the three different positions; an easel position shown in FIG. 2, a display position shown in FIG. 3, and a table position shown in FIG. 4. FIG. 2A shows the cover members 12, 14 rotated from a closed position as shown in FIG. 1, where the cover members 12, 14 cover the storage side 24 of the case 10, to a support position, where the cover members 12, 14 is completely opened and projects rearwardly from the base side 22 to form an angle A of 90° or less with the base side.

Figure 2:
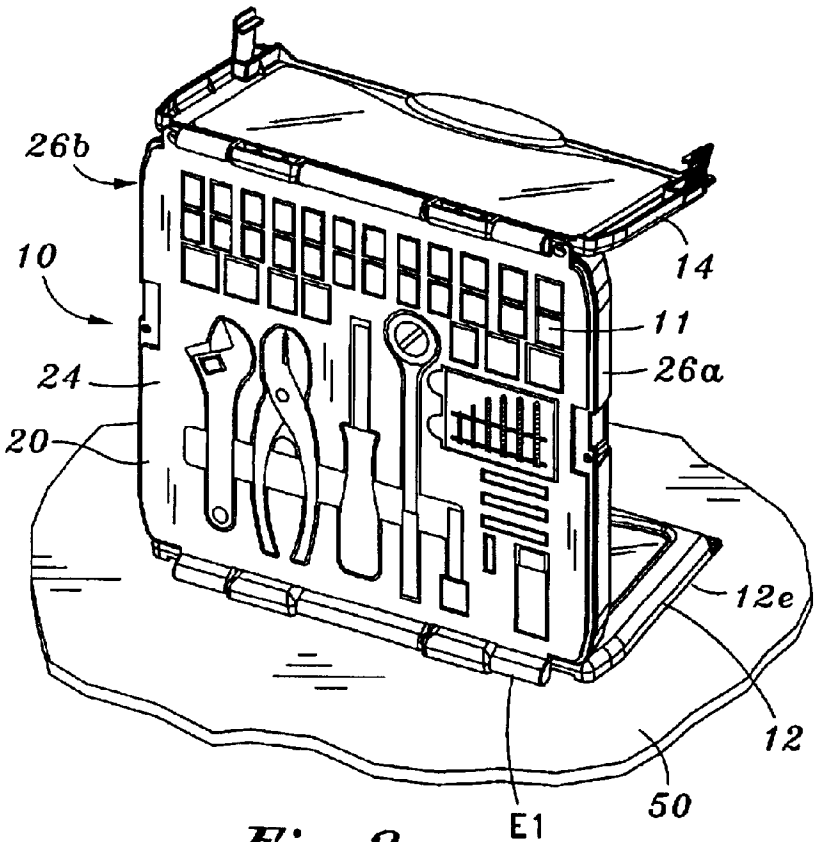
FIG. 2 is a perspective view of the tool case shown in FIG. 1 in an easel orientation.

FIG. 2 illustrates one cover member, namely, the cover member 12, completely opened and rotated into the easel support position, such that the cover member 12 supports the tray body 20 so that it is positioned in an upright state. The cover member 12 has a face side 12*e* that faces the storage side 24 of the tray body 20 when closed, and faces and rests upon a planar support surface 50 when in the first support position, referred to herein as the easel support position. The tray body 20 is supported by the overlay cover member 12, such that a hinged edge E1 is parallel to the support surface 50. The underlay cover member 14 may also be used to support the tray body 20 by simply inverting the case 10 with the cover member 14 completely opened.

Figure 3:
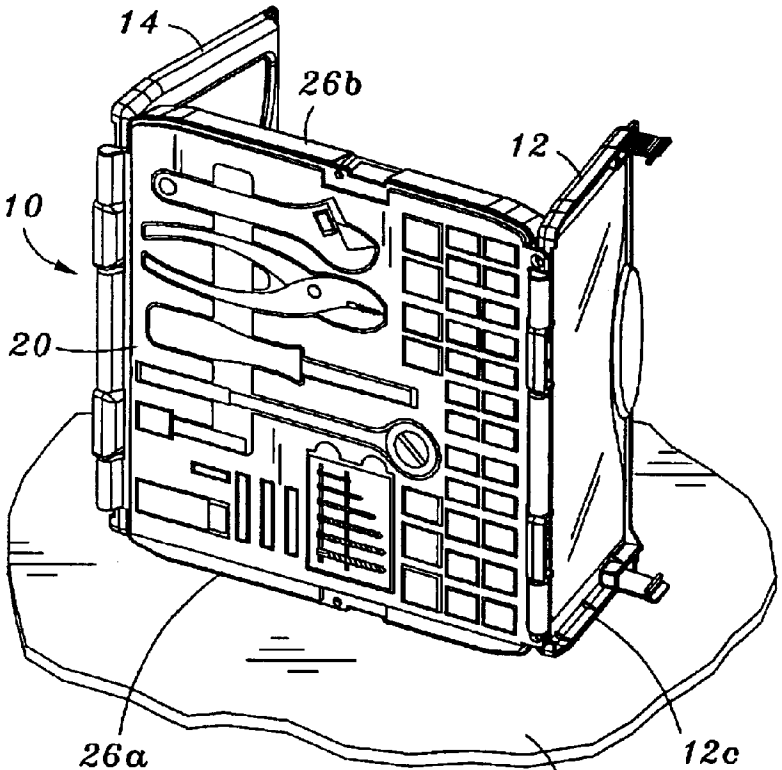
FIG. 3 is a perspective view of the tool case in a display orientation.

FIG. 3 illustrates the two cover members 12, 14 completely opened and both rotated into the display support position, such that an edge 14*c*, 12*c* (FIG. 1) of each cover member 12, 14 rests on the support surface 50. An edge 26*a* of the tray body 20 also rests on the support surface 50, and the tray body 20 is positioned in an upright position.

Figure 4:
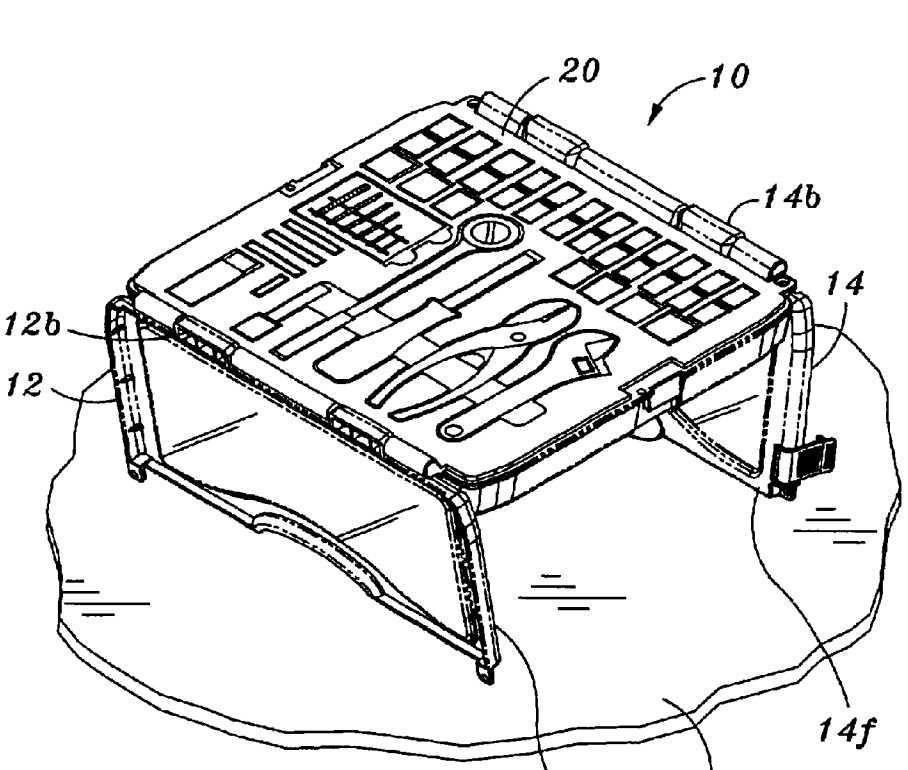
FIG. 4 is a perspective view of the tool case shown in FIG. 1 in a table orientation.

FIG. 4 illustrates the two cover members 12, 14 completely opened and both rotated into the table support position, such that opposing edges 12*f*, 14*f* of each cover member 12, 14 is in contact with the support surface 50, and the tray body 20 is positioned in an elevated, substantially horizontal position above the support surface.

Figure 9:
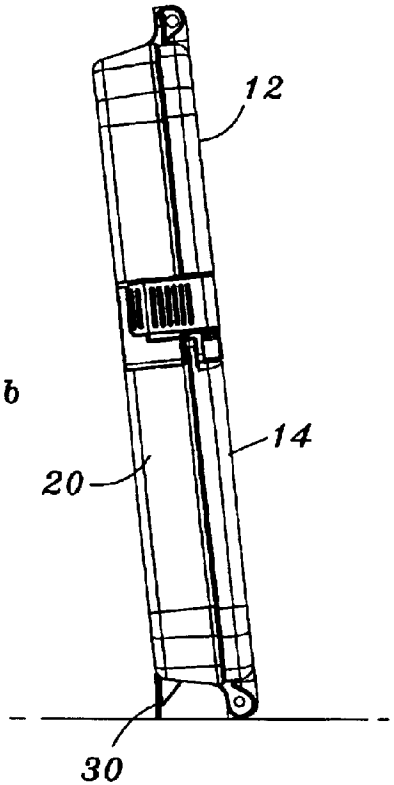
FIG. 9 is an end view of the tool case shown in FIG. 1 showing the case standing on an end with a support insert coupled to the tool case.
Figure 11:
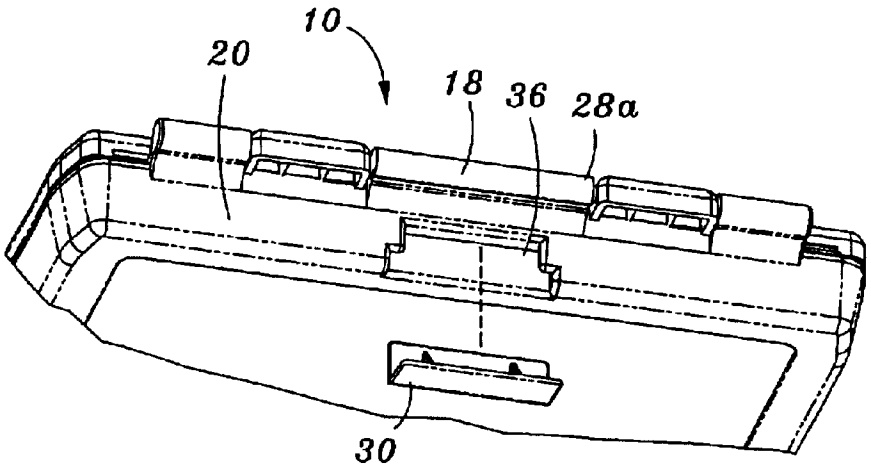
FIG. 11 is an enlarged fragmentary view of the base side of the tool case shown in FIG. 10 illustrating the support insert decoupled from the tool case.
Figure 10:
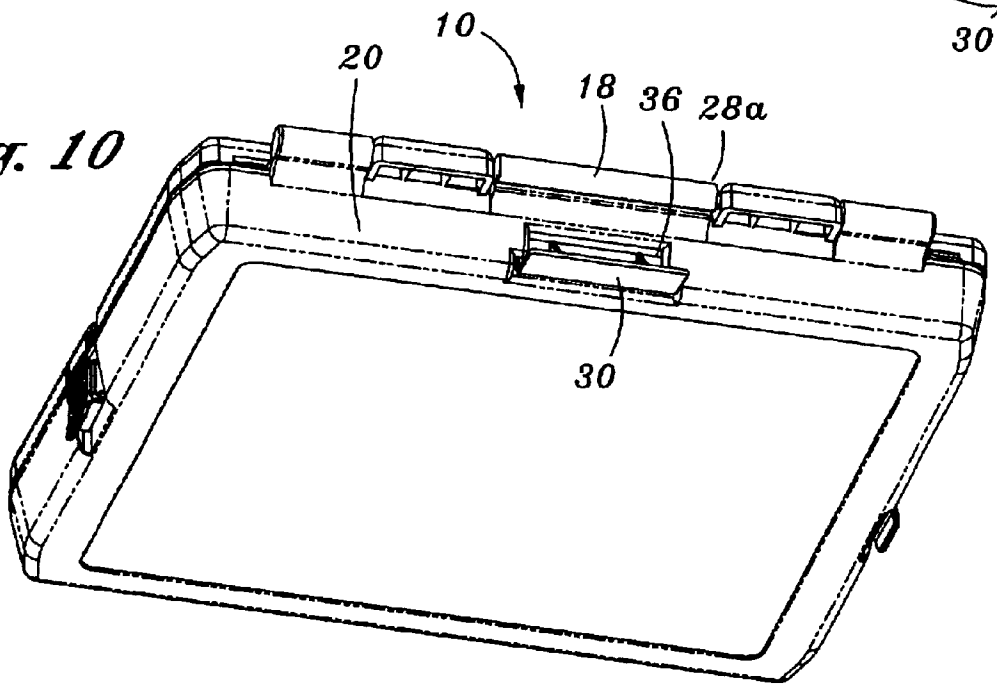
FIG. 10 is perspective view of the base side of the tool case shown in FIG. 1 illustrating the support insert coupled to the tool case.

FIGS. 9, 10 and 11 illustrate a removable support insert 30 that may be used to support the tool case 10 for display without detaching the wire type lock member. Typically, the insert 30 is L-shaped having a pair of legs at substantially a right angle. It is also contemplated that the insert 30 may other shapes, such as, T-shaped. The insert 30 is coupled to the tray body 20 by inserting a leg into a slot 36 located on the tray body 20. Typically the slot 20 is located near one of the edges 26*a*, 26*b*, 28*a*, 28*b* of the tray body 20. The insert 30 is frictionally secure in the slot 36, and is removed by sliding the insert 30 outward. With the insert 30 inserted, the insert serves as a base that rests upon the support surface 50 to orient the case 10 upright as shown in FIG. 9.

Alternative Embodiments of this Invention

Figure 13:
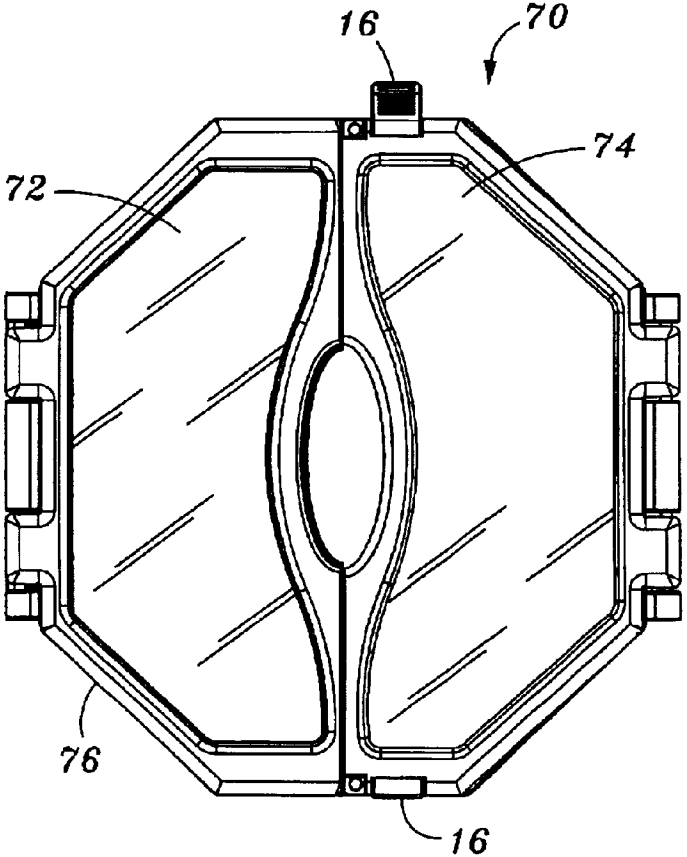
FIG. 13 is a plan view of the hexagonal tool case shown in FIG. 12.
Figure 12:
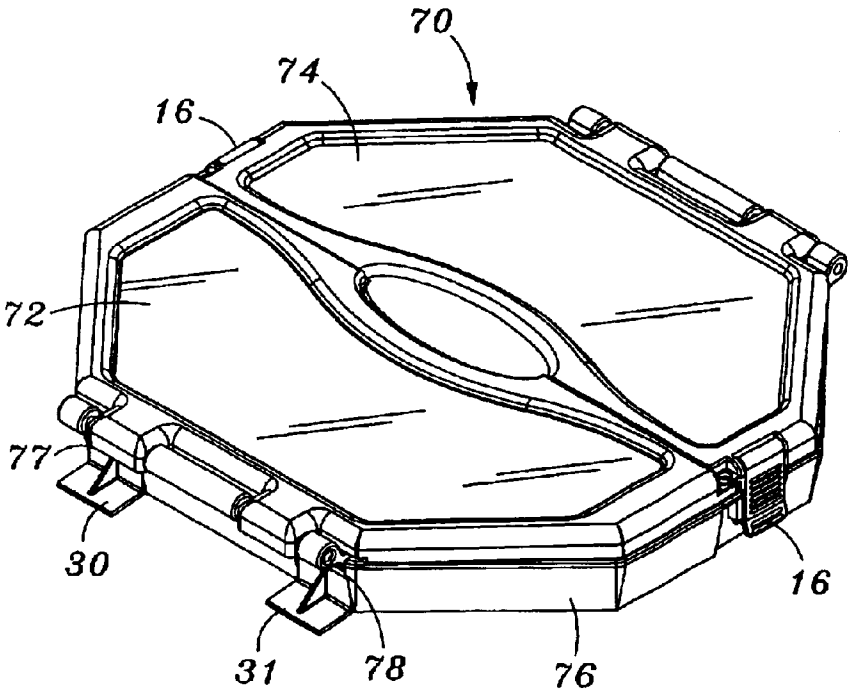
FIG. 12 is a perspective view of one alternative embodiment of the tool case of this invention having a hexagonal configuration.
Figure 14:
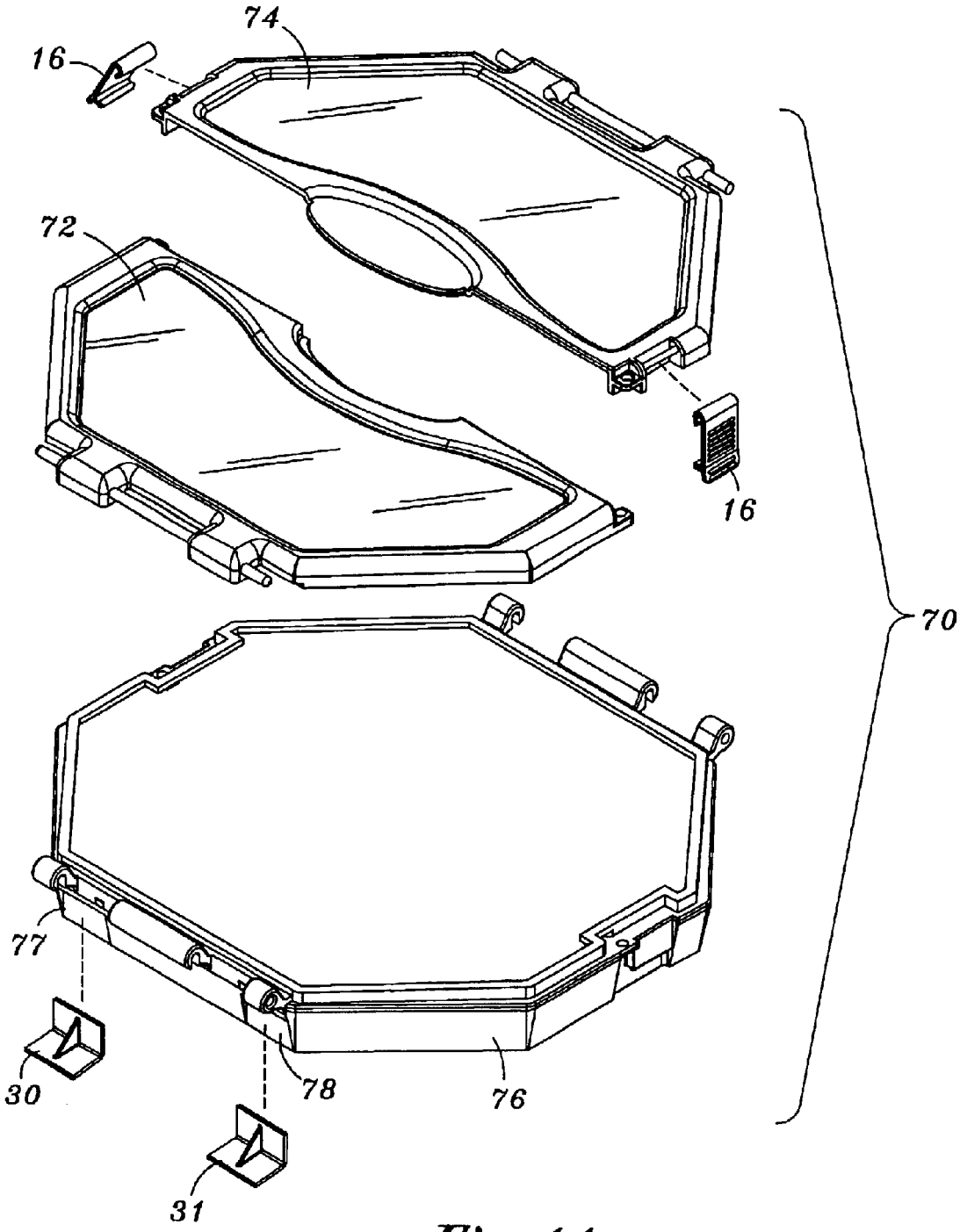
FIG. 14 is a exploded perspective view of the hexagonal tool case shown in FIG. 12 with the cover members decoupled from the main body.
Figure 15:
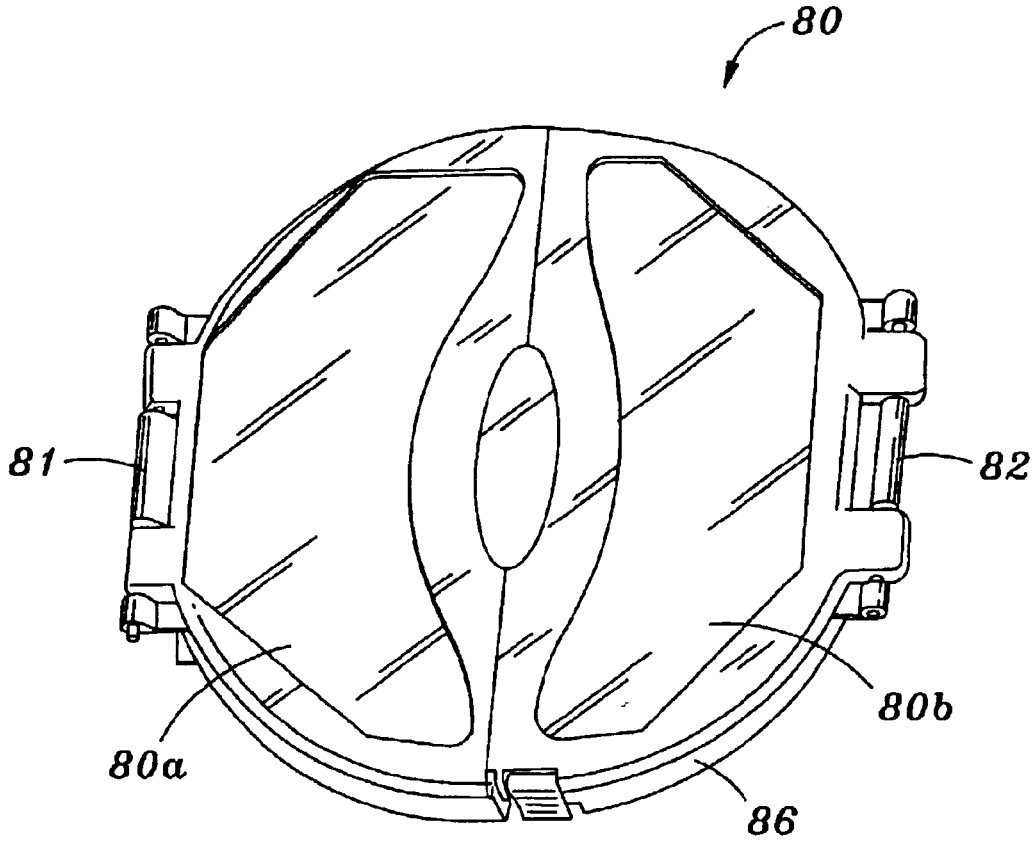
FIG. 15 is a perspective view of another embodiment of the tool case of this invention having a cylindrical configuration.

The general shape of the tool case may take many forms. A tool case having rectangular shaped cover members and main body has been discussed. The shape of the cover members and main body may take other shapes, such as, circular, oval, diamond and hexagonal. FIGS. 12, 13 and 14 illustrate a tool case 70 having hexagonal cover members 72, 74, and a hexagonal main body 76. L-shaped inserts 30, 31 may be inserted into slots 77, 78. The inserts 30, 31 enable the tool case 70 to rest upright on a supporting surface. A pair of latches 16 may be used to secure the cover members 72, 74 in a closed position. FIG. 15 illustrates a tool 80 case that has the general shape of a cylinder. It also includes semi-circular cover members 80*a* and 80*b* attached by hinges 81 and 82 to a circular shaped main body 86. These two alternate embodiments function in substantially the same manner as illustrated in connection with the first embodiment, the tool case 10, to enable these cases to have:

(1) An easel orientation support position where one of the cover members projects outward from the base side and the face surface of this one cover member rests on the planar support surface.

(2) A display orientation support position where one set of edges of both cover member rests on the planar support.

(3) A table orientation support position where another set of edges of both cover member rests on the planar support.

Scope of the Invention

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A portable display case that is capable of storing a plurality of tools, comprising a tray body having a base side, a storage side, and a side edge extending between the base and storage sides, said storage side including a plurality of recesses, each individual recess having an open mouth on the storage side, each said open mouth of each individual recess having a shape substantially identical to the overall shape of an individual tool to be retained in said individual recess, first and second cover members, at least one of said cover members having a transparent section, each said cover member having a pair of opposed side edges, an inner edge, and an outer edge attached to the tray body by at least one hinge member along the side edge of the tray body, each cover member being manually moveable through an arc that is equal to or greater than 270° to move said pair of cover members from a closed position where said cover members substantially cover the storage side to a support position where each said cover member and said base side are at an angle of 90° or less, the first cover member having along its inner edge an overlay portion and the second cover member having along its inner edge an underlay portion, said overlay portion being laid atop of at least a segment of the underlay portion when the cover members are in the closed position, a pair of hinged latch members connected to the first cover member, each latch member having a moveable flap element with a free end, one hinged latch member being along one side edge of the first cover member and the other hinged latch member being along the other side edge of the first cover member, said latch members each having a locking position where the free end of its flap element engages a lip element along the side edge of the tray body, and a removable support member having a pair of legs, one of said legs being inserted into a slot in the side edge of the tray body and the other of said legs serving as a base that rests upon a substantially planar support surface to orient the display case upright.

2. The display case of claim 1 where the tray body and cover members each have a hole therein and said holes are aligned when the cover members are in the closed position so that a lock member may be inserted through the holes to lock the tray body and cover members together.

3. A portable display case that is capable of storing a plurality of tools and is positionable into a multitude of orientations on a substantially planar support surface, comprising a tray body having a base side, a storage side having a first predetermined area, and outer edges that substantially define said first predetermined area, said storage side including a plurality of recesses, each individual recess having an open mouth on the storage side, each said open mouth of each individual recess having a shape substantially identical to the overall shape of an individual tool to be retained in said individual recess, and a pair of substantially equally sized cover members, at least one of said cover members having a transparent section, each cover member having a face surface and outer edges that substantially define a second predetermined area that is substantially equal to a bisection of said first predetermined area, each cover member being attached by a hinge member along one of said outer edges of the tray body and each cover member rotatable from a closed position where the cover member covers substantially half of the storage side and said face surface faces said storage side and a support position where each cover member projects outward from the base side to enable the display case to be supported in one position where the face surface of one of the cover members rests and displays the display case on the planar support surface and another position where each cover member rests and displays the display case on the planar support surface, each said hinge member comprising a cover hinge element integral with said cover member and a tray hinge element integral with said tray body, one of said hinge elements including a pair of spaced apart and aligned hinge components, each said hinge component having substantially the same predetermined width, and a connector member extending between said aligned hinge components, and the other one of said hinge elements including a pair of aligned open spaces, each said open space having a predetermined width that is substantially equal to said predetermined width of said individual aligned hinge components, and a receiver disposed between said aligned open spaces, each one of said individual aligned hinge components being inserted into one of said aligned open spaces and said connector member being inserted into said receiver.

4. The display case of claim 3 where hinge elements are slightly flexible to facilitate connecting said hinge elements together and the connector member is substantially cylindrical and the receiver has a wall comprising a hollow cylindrical configuration with a slot in said wall through which the connector member is inserted.

5. The display case of claim 4 including a removable support member having a pair of legs, one of said legs being inserted into a slot in an outer side edge of the tray body to which a tray hinge element is attached, and the other of said legs projecting outward from the base side in substantially the same plane as the base side, said other of said legs serving as a base that rests upon the substantially planar support surface to orient the display case upright.

6. A portable display case that is capable of storing a plurality of tools, comprising a tray body having a predetermined shape defined by side edges, one of said side edges having a slot therein, said tray body including a base side and a storage side, with the side edges extending between the base and storage sides, said storage side including a plurality of recesses, each individual recess having an open mouth on the storage side, each said open mouth of each individual recess having a shape substantially identical to the overall shape of an individual tool to be retained in said individual recess, first and second cover members, at least one of said cover members having a transparent section, each said cover member having an outer edge attached to said tray body by at least one hinge member along one of the side edges of the tray body, each cover member being manually moveable through an arc that is equal to or greater than 270 to move said pair of cover members from a closed position where said cover members substantially cover the storage side to a support position where each said cover member and said base side are at an angle of 90° or less, and a removable support member having a pair of legs, one of said legs being inserted into said slot and the other of said legs serving as a base that rests upon a support surface to orient the display case upright.

7. The display case of claim 6 where the slot is along a side edge of the tray body to which a hinge member is attached, and the other of said legs projects outward from the base side in substantially the same plane as the base side.

8. The display case of claim 7 where the legs are at substantially a right angle.

9. A portable display case that is capable of storing a plurality of tools, comprising a tray body having a predetermined shape defined by side edges, one of said side edges having a slot therein, said tray body including a base side and a storage side, with the side edges extending between the base and storage sides, said storage side including a plurality of recesses, each individual recess having an open mouth on the storage side, each said open mouth of each individual recess having a shape substantially identical to the overall shape of an individual tool to be retained in said individual recess, and first and second cover members, at least one of said cover members having a transparent section, each said cover member having a pair of opposed side edges, an inner edge, and outer edge rotatably supported on said tray body by at least one hinge member along the side edge of the tray body, each cover member being manually moveable through an arc that is equal to or greater than 270° to move said pair of cover members from a closed position where said cover members substantially cover the storage side to a support position where each said cover member and said base side are at an angle of 90° or less, the first cover member having along its inner edge an overlay portion and the second cover member having along its inner edge an underlay portion so that, when in the cover members are in the closed position, the overlay portion is laid atop of at least a segment of the underlay portion, a pair of hinged latch members connected to the first cover member and aligned and opposed to each other, one hinged latch member being along one side edge of the first cover member and the other hinged latch member being along the other side edge of the first cover member, each latch member having a moveable flap element with a free end, said latch members each having a locking position where its flap element engages a lip element along one of the side edges of the tray body, each said hinge member comprising a cover hinge element integral with said cover member and a tray hinge element integral with said tray body, one of said hinge elements including a pair of spaced apart and aligned hinge components, each hinge component having substantially the same predetermined width and a connector member extending between said aligned hinge components, and the other one of said hinge elements including a pair of aligned open spaces, each aligned open space having a predetermined width that is substantially equal to said predetermined width of said individual aligned hinge components and a receiver disposed between said aligned open spaces, each one of said individual aligned hinge components being inserted into one of said aligned open spaces and said connector member being inserted into said receiver, and a removable support member having a pair of legs, one of said legs being inserted into said slot and the other of said legs serving as a base that rests upon the support surface to orient the display case upright.

10. A portable display case that is capable of storing a plurality of tools, comprising a tray body having a base side, a storage side, and a side edge extending between the base and storage sides, said storage side including a plurality of recesses, each individual recess having an open mouth on the storage side, each said open mouth of each individual recess having a shape substantially identical to the overall shape of an individual tool to be retained in said individual recess, first and second cover members, at least one of said cover members having a transparent section, each said cover member having a pair of opposed side edges, an inner edge and an outer edge attached to the tray body by at least one hinge member along the side edge of the tray body, each cover member being manually moveable through an arc that is equal to or greater than 270° to move said pair of cover members from a closed position where said cover members substantially cover the storage side to a support position where each said cover member and said base side are at an angle of 90° or less, the first cover member having along its inner edge an overlay portion and the second cover member having along its inner edge an underlay portion, said overlay portion being laid atop of at least a segment of the underlay portion when the cover members are in the closed position, at least one latch member when latched holds the cover members together in the rinsed position and when unlatched enabling the rover members to he moved to the support position, said tray body and cover members each having a hole therein and said holes being aligned when the cover members are in the closed position so that a lock member may be inserted through the holes to lock the tray body and cover members together, and a removable support member having a pair of legs, one of said legs being inserted into a slot in the side edge of the tray body and the other of said legs serving as a base that rests upon a substantially planar support surface to orient the display case upright.

* * * * *